US006485796B1

(12) United States Patent
Carpenter et al.

(10) Patent No.: US 6,485,796 B1
(45) Date of Patent: Nov. 26, 2002

(54) METHOD OF MAKING METAL MATRIX COMPOSITES

(75) Inventors: Michael W. Carpenter, St. Paul, MN (US); John L. Sinz, Menomonie, WI (US); Paul S. Werner, Woodbury, MN (US); Lawrence A. Crum, Bellevue, WA (US); Herve E. Deve, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/616,589

(22) Filed: Jul. 14, 2000

(51) Int. Cl.[7] ..... B05D 3/00; B05D 1/18; B05D 3/04

(52) U.S. Cl. ..... 427/601; 427/177; 427/294; 427/314; 427/431; 427/434.5; 427/434.6; 427/434.7; 427/443.2

(58) Field of Search ..... 427/601, 177, 427/294, 314, 431, 433, 434.5, 434.6, 443.2, 434.7

(56) References Cited

U.S. PATENT DOCUMENTS

| | | | | |
|---|---|---|---|---|
| 3,547,180 A | | 12/1970 | Cochran et al. | |
| 3,913,657 A | * | 10/1975 | Banker et al. | 164/62 |
| 4,053,011 A | * | 10/1977 | Riewald et al. | 164/97 |
| 4,649,060 A | | 3/1987 | Ishikawa et al. | 427/57 |
| 4,779,563 A | | 10/1988 | Ishikawa et al. | 118/612 |
| 4,877,643 A | | 10/1989 | Ishikawa et al. | 427/57 |
| 4,961,990 A | | 10/1990 | Yamada et al. | 428/240 |
| 5,171,942 A | | 12/1992 | Powers | 174/129 R |
| 5,286,560 A | * | 2/1994 | Fishkis et al. | 428/357 |
| 5,554,826 A | | 9/1996 | Gentry | 174/128.1 |
| 5,736,199 A | | 4/1998 | Blucher | 427/430 |

FOREIGN PATENT DOCUMENTS

| | | | |
|---|---|---|---|
| EP | 0 162 542 B1 | | 7/1992 |
| JP | S54-89907 | | 7/1979 |
| JP | 3-198956 A | * | 8/1991 |
| JP | Hei 6-158197 | | 6/1994 |
| WO | WO 83/02782 | | 8/1983 |
| WO | WO 92/14860 | | 9/1992 |
| WO | WO 97/00976 | * | 1/1997 |

OTHER PUBLICATIONS

Y. Yasutomi, et al., "Effects of the SiC/Al interface reaction on fracture behavior of a composite conductor using SiC fiber reinforced aluminum for next generation power equipment", *Journal of Materials Science* 34 (1999) pp. 1583–1593.

Chenge Zhang and Lingsen Wang, "SiC Fiber/Aluminum Preform Wires Fabricated By Ultrasonic Liquid Infiltration Process", Central South Univ. of Technology, Changsha (China) 1995, pp. 1–5.

Hong Wan, Jin Pan, Deming Yang, "In–Situ Aluminum Matrix Composite Prepared by Ultrasonic Vibration", Proceedings of ICCM–10, Whistler, B.C. Canada, Aug. 1995, pp. 161–167.

L. Pennander and C–H Andersson, "Vibration Exitated Low Pressure Casting, A New Route to Produce Preform Based Metal Matrix Composite Materials", Proceedings of the 12$^{th}$ Risø International Symposium on Materials Science, 2–6 Sep. 1991.

(List continued on next page.)

*Primary Examiner*—Michael Barr
(74) *Attorney, Agent, or Firm*—Melanie Gover

(57) ABSTRACT

Methods for making metal matrix composite articles such as wires and tapes. The metal matrix composites include a plurality of substantially continuous, longitudinally positioned fibers in a metal matrix. The fibers are selected from the group of ceramic fibers, boron, carbon fibers, and mixtures thereof.

32 Claims, 8 Drawing Sheets

OTHER PUBLICATIONS

J. Pan, C. Li, D.M. Yang and X.F. Yin, "A Study About the Mechanism of Ultrasonic Liquid Infiltration for $SiC_f$/A1 Composites", Proceedings of the Ninth International Conference on Composite Materials (ICCM/9), Madrid, Jul. 12–16, 1993.

L–O Pennander et al., "Vibration Excitated Low–Pressure Casting, A New Route to Produce Metal Matrix Composites", Mar. 1, 1991, ICCM/VIII, Section 12–21.

T. Yamauchi and Y. Nishida, "Infiltration Kinetics of Fibrous Preforms by Aluminium with Solidification", (Title unreadable) vol. 43(?), pp. 1313–1321, 1995 [Best copy available].

Robert G. Shaver, "Metal Matrix Compositing by Continuous Casting", Proceedings of the Sixth St. Louis Symposium, May 11–12, 1972.

H. Nakanishi et al., "Ultrasound–assisted pressureless infiltration of molten aluminium into alumina capillaries", *Journal of Materials Science Letters* 12 (1993) pp. 1313–1315.

J. Pan, D.M. Yang and X.F. Yin, "A study of the ultrasonic technique applied in fabrication of SiC fiber–reinforced aluminum composites", *J. Mater. Res.*, vol. 10, No. 3, Mar. 1995, pp. 596–601.

Yang Deming, Yin Xinfang, Pan Jin, "Continuous yarn fibre–reinforced aluminum composites prepared by the ultrasonic liquid infiltration method", *Journal of Materials Science Letters* 12 (1993) pp. 252–253.

A.J. Cook and P.S. Werner, "Pressure Infiltration Casting of Metal Matrix Composites", *Materials Science and Engineering*, A144 (1991) pp. 189–206.

Akio Ozawa et al., "Mechanical Characteristics of SiC Fiber Reinforced Aluminum Composite Material", 1995 The Electricity Society National Symposium.

Akio Ozawa et al., "Mechanical Characteristics of SiC fiber reinforced Composite Wire", 1996 The Electricity Society National Symposium.

Akio Ozawa et al., "Development and Evaluation Characteristics of SiC Fiber Reinforced Aluminum Composite Wires for Transmission Line", 1995 The Electricity Society Electronics and Energy Department Symposium.

H. Gigerenzer et al., "Hot–Drawing of Fiber (Filament ) Reinforced Metal–Matrix Composites", Proceedings of the 1978 International Conference on Composite Materials, ICCM/2, Apr. 16–20, 1978.

David M. Goddard et al., "Continuous Graphite Fiber MMCs", *Engineered Materials Handbook*, vol. 1, Composites, 1987.

Howard A. Katzman, "Fiber Coatings for Composite Fabrication", *Materials & Manufacturing Processes*, 5(1), 1–15 (1990).

H.M. Cheng et al., "Preparation of Carbon Fibre Reinforced Aluminium Via Ultrasonic Liquid Infiltration Technique", *Materials Science and Technology*, Jul. 1993, vol. 9, pp. 609–614.

H. Gigerenzer et al., "Drawing of Graphite Fiber Reinforced Aluminum Composites", Failure Modes in Composites IV, Proceedings of a symposium sponsored by the TMS–AIME/ASM Joint Composite Material Committee, Oct. 24–26, 1977, pp. 359–369.

Joseph T. Blucher et al., "A New Pressure Infiltration Process for Continuous Production of Fiber Reinforced MMC Structural Elements", $30^{th}$ International SAMPLE Technical Conference, Oct. 20–24, 1998.

Y. Tsunekawa et al., "Application of Ultrasonic Vibration to Molten Aluminum Infiltration", *Key Engineering Materials* vols. 104–107 (1995) pp. 215–224.

J.H. Nader et al., "Correlation of Thermal Models with Microstructural Effects in Continuous MMC Wire Production", *Materials Science and Engineering* A266 (1999) 52–61.

M.G. Williams et al., "Analytically Motivated Process Improvements in Continuous Metal–Matrix Composite Wire Fabrication", *Materials Science and Engineering* A266 (1999) 86–92.

* cited by examiner

METHOD OF MAKING METAL MATRIX COMPOSITES

FIELD OF THE INVENTION

The present invention pertains to a method for making metal matrix composites reinforced with substantially continuous fibers within a metal matrix.

BACKGROUND OF THE INVENTION

Metal matrix composite's (MMC's) have long been recognized as promising materials due to their combination of high strength and stiffness combined with low weight. MMC's typically include a metal matrix reinforced with fibers. Examples of metal matrix composites include aluminum matrix composite wires (e.g., silicon carbide, carbon, boron, or polycrystalline alpha alumina fibers in an aluminum matrix), titanium matrix composite wires and tapes (e.g., silicon carbide fibers in a titanium matrix), and copper matrix composite tapes (e.g., silicon carbon fibers in a copper matrix).

The presence of imperfections in the wire such as intermetallic phases, dry (i.e., uncoated) fiber, porosity as a result, for example, of shrinkage or internal gas (e.g., hydrogen or water vapor) voids, etc. are known to decrease properties such as strength the of the wire. These imperfections can result from impurities in constituents (i.e., material of the metal matrix and the fiber), incompatibility of constituents, as well as incomplete infiltration of the matrix material into fibers.

The use of some metal matrix composite wires as a reinforcing member in bare overhead electrical power transmission cables is of particular interest. The need for new materials in such cables is driven by the need to increase the power transfer capacity of existing transmission infrastructure due to load growth and changes in power flow due to deregulation.

The availability of a wider variety of wires, including a variety of different wire diameters, is desirable in providing greater design variation in cable constructions. For example, a wider variety of wires of different diameter can provide cables within a wider range of diameters, as well as a wider range of stiffness or flexibility. A wider range of diameters also allows for a wider range of cable designs, such as larger cable diameter, as well as simplicity of manufacture of cables. Thus, there is a need for a process of making a substantially continuous metal matrix composite wire with relatively large diameter.

Further, there is a continuing need for methods for making metal matrix composite articles such as wires and tapes having desired or enhanced performance characteristics such as high strength.

SUMMARY OF THE INVENTION

The present invention relates to continuous methods for making substantially continuous fiber metal matrix composites. Embodiments of the present invention pertain a method for making metal matrix composites (e.g., composite wires) having a plurality of substantially continuous, longitudinally positioned fibers contained within a metal matrix. The infiltration in the methods according to the present invention is conducted substantially at atmospheric pressure (about 1 atmosphere), as opposed to pressure infiltration methods for making metal matrix composite materials. Metal aluminum matrix composites made according to the present invention preferably exhibit desirable properties with respect to elastic modulus, density, coefficient of thermal expansion, electrical conductivity, and strength.

In one aspect, the present invention provides a method for making a continuous, elongated metal matrix composite article (e.g., wires and tapes), the method comprising:

- providing a contained volume of molten metallic matrix material; evacuating a plurality of at least one of substantially continuous, longitudinally positioned ceramic, boron, or carbon fibers in a vacuum;
- immersing the evacuated plurality of substantially continuous fibers into the contained volume of molten metallic matrix material, wherein the evacuated plurality of substantially continuous fibers is introduced under a vacuum into the molten metallic material;
- imparting ultrasonic energy to cause vibration of at least a portion of the contained volume of molten metal matrix material to permit at least a portion of the molten metal matrix material to infiltrate into the plurality of fibers such that an infiltrated plurality of fibers is provided; and
- withdrawing the infiltrated plurality of fibers from the contained volume of molten metallic matrix material under conditions which permit the molten metallic matrix material to solidify to provide a continuous, elongated metal composite article comprising a plurality of at least one of substantially continuous, longitudinally positioned ceramic, boron, or carbon fibers in a metal matrix.

Preferably, the plurality of fibers are in the form of a tow(s).

In another aspect, the present invention provides a method for making a continuous, elongated metal composite article (e.g., wires and tapes), the method comprising:

- providing a contained volume of molten metallic matrix material (e.g., aluminum);
- immersing a plurality of at least one of substantially continuous, longitudinally positioned ceramic, boron, or carbon fibers into the contained volume of molten metallic matrix material;
- imparting ultrasonic energy to cause vibration of at least a portion of the contained volume of molten metal matrix material to permit at least a portion of the molten metal matrix material to infiltrate into the plurality of fibers such that an infiltrated plurality of fibers is provided, wherein the molten metallic matrix material has a hydrogen content less than 0.2 $cm^3$/100 grams (preferably, less than 0.15 $cm^3$/100 grams, more preferably, less than 0.1 $cm^3$/100 grams) of metal (e.g., aluminum); and
- withdrawing the infiltrated plurality of fibers from the contained volume of molten metallic matrix material under conditions which permit the molten metallic matrix material to solidify to provide a continuous, elongated metal composite article comprising a plurality of at least one of substantially continuous, longitudinally positioned ceramic, boron, or carbon fibers in a metal matrix.

Preferably, the plurality of fibers are in the form of a tow(s).

In another aspect, articles made by a method according to the present invention preferably has a length of at least 10 meters (preferably, at least 25 meters, 50 meters, 100 meters, 200 meters, 300 meters, 400 meters, 500 meters, 600 meters, 700 meters, 800 meters, 900 meters, 1000 meters, or more). In another aspect, articles made according to a method of the present invention preferably have a minimum dimension of at least 2.5 mm (more preferably, at least 3 mm or 3.5 mm)

over a length of at least 10 meters (preferably, at least 25 meters, 50 meters, 100 meters, 200 meters, 300 meters, 400 meters, 500 meters, 600 meters, 700 meters, 800 meters, 900 meters, 1000 meters, or more). Certain preferred metal matrix composite articles made by a method according to the present invention have a have a minimum dimension in the range from about 2.5 mm to about 4 mm over a length of at least 10 meters (preferably, at least 25 meters, 50 meters, 100 meters, 200 meters, 300 meters, 400 meters, 500 meters, 600 meters, 700 meters, 800 meters, 900 meters, 1000 meters, or more).

In another aspect, wire made by a method of the present invention preferably has a length of at least 10 meters (preferably, at least 25 meters, 50 meters, 100 meters, 200 meters, 300 meters, 400 meters, 500 meters, 600 meters, 700 meters, 800 meters, 900 meters, 1000 meters, or more). In another aspect, wire made by a method according the present invention preferably has a diameter of at least 2.5 mm (more preferably, at least 3 mm or 3.5 mm) over a length of at least 10 meters (preferably, at least 25 meters, 50 meters, 100 meters, 200 meters, 300 meters, 400 meters, 500 meters, 600 meters, 700 meters, 800 meters, 900 meters, 1000 meters, or more). Certain preferred metal matrix composite wires made by the method of the present invention have a diameter in the range from about 2.5 mm to about 4 mm over a length of at least 10 meters (preferably, at least 25 meters, 50 meters, 100 meters, 200 meters, 300 meters, 400 meters, 500 meters, 600 meters, 700 meters, 800 meters, 900 meters, 1000 meters, or more).

DEFINITIONS

As used herein, the following terms are defined as:

"Substantially continuous fiber" means a fiber having a length that is relatively infinite when compared to the average fiber diameter. Typically, this means that the fiber has an aspect ratio (i.e., ratio of the length of the fiber to the average diameter of the fiber) of at least about $1\times10^5$, preferably, at least about $1\times10^6$, and more preferably, at least about $1\times10^7$. Typically, such fibers have a length on the order of at least about 50 meters, and may even have lengths on the order of kilometers or more, and for articles less than 50 meters in length, the length of the fibers is typically the length of the composite article.

"Longitudinally positioned" means that the fibers are oriented in the same direction as the length of the wire.

DETAILED DESCRIPTION OF PREFERRED EMBODIMENTS

Figure 1:
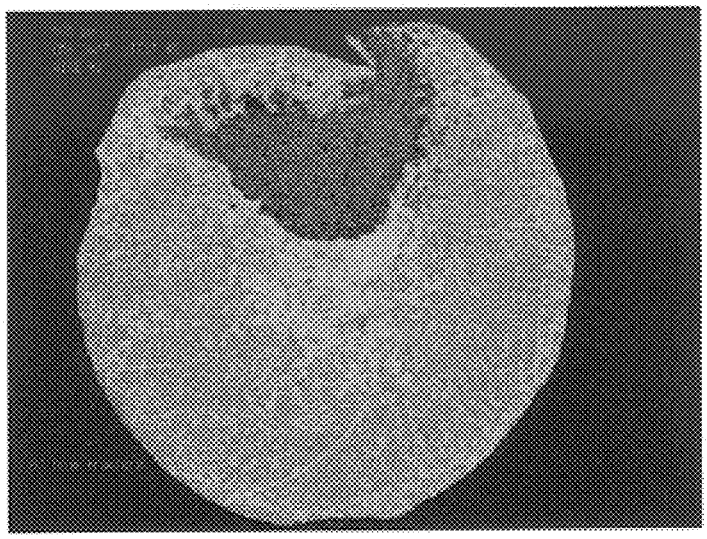
FIG. 1 is a photomicrograph of a cross-section of a metal matrix composite wire showing a local region in which only the fibers are present, devoid of matrix.
Figure 2:
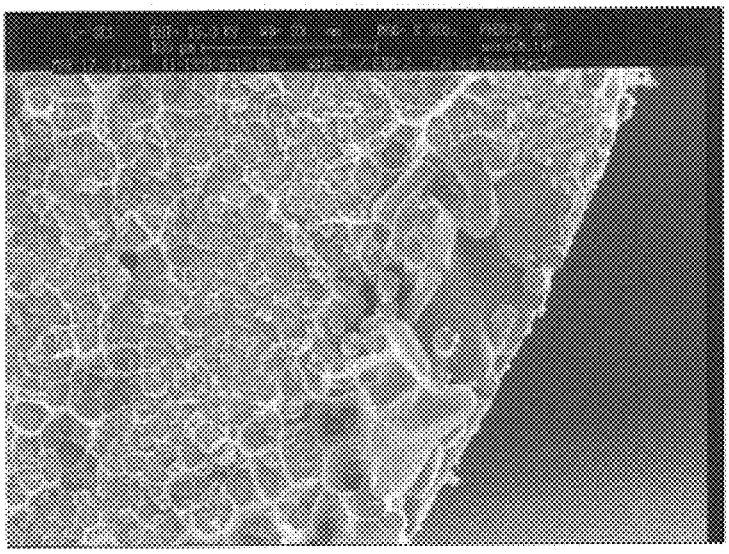
FIG. 2 is a scanning electron micrograph of a cross-section of a metal matrix composite wire showing shrinkage porosity.
Figure 3:
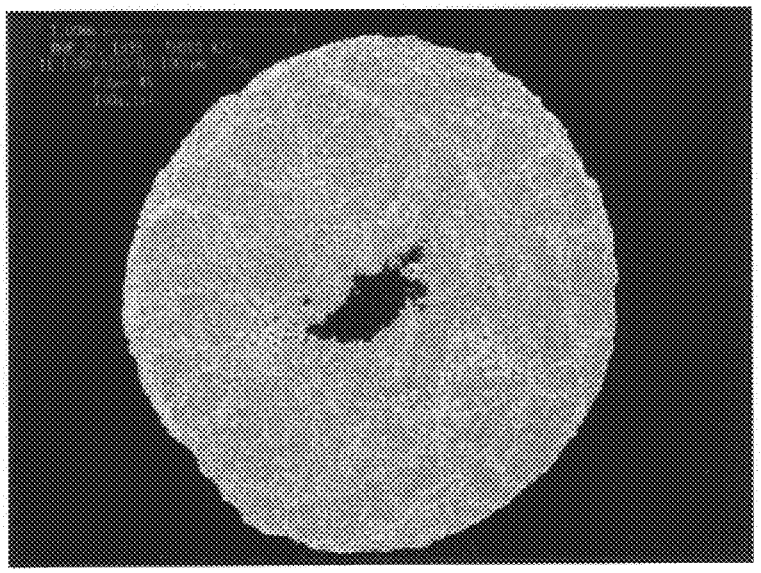
FIG. 3 is a scanning electron micrograph of a cross-section of a metal matrix composite wire showing voids created due to the presence of trapped gas (e.g., hydrogen or water vapor).
Figure 4:
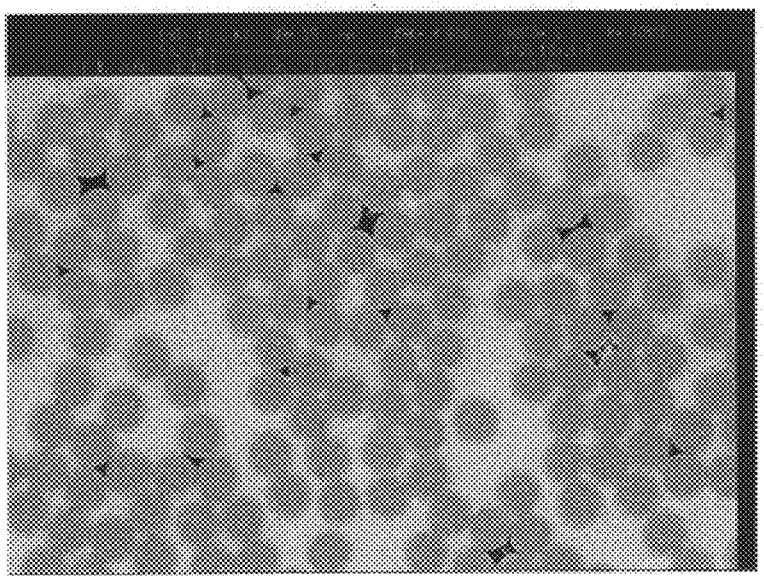
FIG. 4 is a scanning electron micrograph of a cross-section of a metal matrix composite wire showing microporosity.

Although it is known that the presence of imperfections in the wire such as intermetallic phases, dry fiber, porosity as a result, for example, of shrinkage or internal gas (e.g., hydrogen or water vapor) voids, etc. are known to decrease properties such as the strength of the wire, while not wanting to be bound by theory, Applicants have discovered and believe that the presence imperfections in known metal matrix composite wires is more prevalent along lengths of wire and tape than is known in the art. For example, testing or analyzing a meter of wire or tape for properties and other characteristics, does not necessarily mean that a 10 meters, 50 meter, 100 meter, etc. length of the wire or tape will consistently exhibit the desired degree of properties or characteristics. Such imperfections in the wire or tape include local intermetallic phases, local dry (i.e., uncoated) fiber (see, e.g., FIG. 1), porosity as a result of shrinkage (see, e.g., FIG. 2) or internal gas voids (see, e.g., FIG. 3), and microporosity (see, e.g., FIG. 4). It is believed that such imperfections can dramatically decrease properties such as strength the of the metal matrix composite article. Although not wanting to be bound by theory, preferred articles made by Applicants inventive method are believed to have significantly reduced (or to have eliminated) one or more of such imperfections along its length, as compared to the art, thereby providing wire with significantly improved properties exhibited, for example, for some embodiments in that they have a bend failure value of zero over lengths of at least 300 meters.

The method according to the present invention provides fiber reinforced metal matrix composite articles such as wires, tapes, and rods. Such composites include a plurality of substantially continuous, longitudinally positioned, reinforcing fibers such as ceramic(e.g., $Al_2O_3$-based) reinforcing fibers encapsulated within a matrix that includes one or more metals (e.g., highly pure elemental aluminum or alloys of pure aluminum with other elements, such as copper). Preferably, at least about 85% by number of the fibers are substantially continuous in the metal matrix composite article.

The substantially continuous reinforcing fibers preferably have an average diameter of at least about 5 micrometers. Preferably, the average fiber diameter is no greater than about 250 micrometers, more preferably, no greater than about 100 micrometers. For fibers available in the form of tows (such as ceramic oxide fibers, some silicon carbide fibers (which are also available in monofilament forms), and carbon fibers the average fiber diameter is preferably, no greater than about 50 micrometers, more preferably, no greater than about 25 micrometers.

Preferably, the fibers have a modulus of no greater than about 1000 GPa, and more preferably, no greater than about 420 GPa. Preferably, fibers have a modulus of greater than about 70 GPa.

Examples of substantially continuous fibers that may be useful for making metal matrix composite materials according to the present invention include ceramic fibers, such as metal oxide (e.g., alumina) fibers, silicon carbide fibers, boron fibers, and carbon fibers. Typically, the ceramic oxide fibers are crystalline ceramics and/or a mixture of crystalline ceramic and glass (i.e., a fiber may contain both crystalline ceramic and glass phases).

Preferably, the ceramic fibers have an average tensile strength of at least about 1.4 GPa, more preferably, at least about 1.7 GPa, even more preferably, at least about 2.1 GPa, and most preferably, at least about 2.8 GPa. Preferably, the carbon fibers have an average tensile strength of at least about 1.4 GPa, more preferably, at least about 2.1 GPa; even more preferably, at least about 3.5 GPa; and most preferably, at least about 5.5 GPa.

Ceramic fibers are available commercially as single filaments, or grouped together (e.g., as yarns or tows)). Yarns or tows preferably comprise at least 780 individual fibers per tow, and more preferably at least 2600 individual fibers per tow. Tows are well known in the fiber art and refer to a plurality of (individual) fibers (typically at least 100 fibers, more typically at least 400 fibers) collected in a rope-like form. Ceramic fibers, including tows of ceramic fibers, are available in a variety of lengths, including 300 meters and longer. The fibers may have a cross-sectional shape that is circular or elliptical.

Methods for making alumina fibers are known in the art and include the method disclosed in U.S. Pat. No. 4,954,462 (Wood et al.), the disclosure of which is incorporated herein by reference.

Preferably, the alumina fibers are polycrystalline alpha alumina-based fibers and comprise, on a theoretical oxide basis, greater than about 99 percent by weight $Al_2O_3$and about 0.2–0.5 percent by weight $SiO_2$, based on the total weight of the alumina fibers. In another aspect, preferred polycrystalline, alpha alumina-based fibers comprise alpha alumina having an average grain size of less than 1 micrometer (more preferably, less than 0.5 micrometer). In another aspect, preferred polycrystalline, alpha alumina-based fibers have an average tensile strength of at least 1.6 GPa (preferably, at least 2.1 GPa, more preferably, at least 2.8 GPa). Preferred alpha alumina fibers are commercially available under the trade designation "NEXTEL 610" from the 3M Company of St. Paul, Minn.

Suitable aluminosilicate fibers are described in U.S. Pat. No. 4,047,965 (Karst et al.), the disclosure of which is incorporated herein by reference. Preferably, the aluminosilicate fibers comprise, on a theoretical oxide basis, in the range from about 67 to about 85 percent by weight $Al_2O_3$ and in the range from about 33 to about 15 percent by weight $Sio_2$, based on the total weight of the aluminosilicate fibers.

Some preferred aluminosilicate fibers comprise, on a theoretical oxide basis, in the range from about 67 to about 77 percent by weight $Al_2O_3$ and in the range from about 33 to about 23 percent by weight $SiO_2$, based on the total weight of the aluminosilicate fibers. One preferred aluminosilicate fiber comprises, on a theoretical oxide basis, about 85 percent by weight $Al_2O_3$ and about 15 percent by weight $SiO_2$, based on the total weight of the aluminosilicate fibers. Another preferred aluminosilicate fiber comprises, on a theoretical oxide basis, about 73 percent by weight $Al_2O_3$ and about 27 percent by weight $Sio_2$, based on the total weight of the aluminosilicate fibers. Preferred aluminosilicate fibers are commercially available under the trade designations "NEXTEL 440" ceramic oxide fibers, "NEXTEL 550" ceramic oxide fibers, and "NEXTEL 720" ceramic oxide fibers from the 3M Company.

Suitable aluminoborosilicate fibers are described in U.S. Pat. No. 3,795,524 (Sowman), the disclosure of which is incorporated herein by reference. Preferably, the aluminoborosilicate fibers comprise, on a theoretical oxide basis: about 35 percent by weight to about 75 percent by weight (more preferably, about 55 percent by weight to about 75 percent by weight) $Al_2O_3$; greater than 0 percent by weight (more preferably, at least about 15 percent by weight) and less than about 50 percent by weight (more preferably, less than about 45 percent, and most preferably, less than about 44 percent) $SiO_2$; and greater than about 5 percent by weight (more preferably, less than about 25 percent by weight, even more preferably, about 1 percent by weight to about 5 percent by weight, and most preferably, about 10 percent by weight to about 20 percent by weight) $B_2O_3$, based on the total weight of the aluminoborosilicate fibers. Preferred aluminoborosilicate fibers are commercially available under the trade designation "NEXTEL 312" from the 3M Company.

Suitable silicon carbide fibers are commercially available, for example, from COI Ceramics of San Diego, Calif. under the trade designation "NICALON" in tows of 500 fibers, from Textron Systems of Wilmington, Mass. under the trade designations "SCS-2, SCS-6, SCS-9A, SCS-ULTRA", from Ube Industries of Japan, under the trade designation "TYRANNO", and from Dow Coming of Midland, Mich. under the trade designation "SYLRAMIC".

Suitable carbon fibers are commercially available, for example, from Amoco Chemicals of Alpharetta, GA under the trade designation "THORNEL CARBON" in tows of 2000, 4000, 5,000, and 12,000 fibers, Hexcel Corporation of Stamford, Conn., from Grafil, Inc. of Sacramento, Calif. (subsidiary of Mitsubishi Rayon Co.) under the trade designation "PYROFIL", Toray of Tokyo, Japan, under the trade designation "TORAYCA", Toho Rayon of Japan, Ltd. under the trade designation "BESFIGHT", Zoltek Corporation of St. Louis, Mo. under the trade designations "PANEX" and "PYRON", and Inco Special Products of Wyckoff, N.J. (nickel coated carbon fibers), under the trade designations "12K20" and "12K50".

Suitable boron fibers are commercially available, for example, as monofilaments from Textron Systems, Willington, Mass.

Commercially available fibers typically include an organic sizing material added to the fiber during their manufacture to provide lubricity and to protect the fiber strands during handling. It is believed that the sizing tends to reduce the breakage of fibers, reduces static electricity, and reduces the amount of dust during, for example, conversion to a fabric. The sizing can be removed, for example, by dissolving or burning it away. Preferably, the sizing is removed before forming the metal matrix composite wire according to the present invention. In this way, before forming the aluminum matrix composite wire the ceramic oxide fibers are free of any sizing thereon.

It is also within the scope of the present invention to have coatings on the fibers. Coatings may be used, for example, to enhance the wettability of the fibers, to reduce or prevent reaction between the fibers and molten metal matrix material. Such coatings and techniques for providing such coatings are known in the fiber and metal matrix composite art.

Metal matrix composite articles made by a method according to the present invention preferably comprise at least 15 percent by volume (more preferably, in increasing preference, at least 20, 25, 30, 35, 40, or 50 percent by volume) of the fibers, based on the total volume of the fibers and matrix material. Typically, metal matrix composite articles made by a method according to the present invention comprise in the range from about 30 to about 70 (preferably, about 40 to about 60) percent by volume of the fibers, based on the total volume of the fibers and matrix material.

Preferred metal matrix composite wires made according to the present invention have a length, in order of preference, of at least about 300 meters, at least about 400 meters, at least about 500 meters, at least about 600 meters, at least about 700 meters, at least about 800 meters, and at least about 900 meters, over which they demonstrate zero breaks (i.e., a bend failure value of zero) according to the Wire Proof Test described herein.

The average diameter of the wire made according to the present invention is preferably at least about 0.5 millimeter (mm), more preferably, at least about 1 mm, and more preferably at least about 1.5 mm.

The matrix material may be selected such that the matrix material does not significantly react chemically with the fiber material (i.e., is relatively chemically inert with respect to fiber material), for example, to eliminate the need to provide a protective coating on the fiber exterior. Preferred metal matrix materials include aluminum, zinc, tin, and alloys thereof (e.g., an alloy of aluminum and copper). More preferably, the matrix material includes aluminum and alloys thereof. For aluminum matrix materials, preferably, the matrix comprises at least 98 percent by weight aluminum, more preferably, at least 99 percent by weight aluminum, even more preferably, greater than 99.9 percent by weight aluminum, and most preferably, greater than 99.95 percent by weight aluminum. Preferred aluminum alloys of aluminum and copper comprise at least about 98 percent by weight Al and up to about 2 percent by weight Cu. Although higher purity metals tend to be preferred for making higher tensile strength wires, less pure forms of metals are also useful.

Suitable metals are commercially available. For example, aluminum is available under the trade designation "SUPER PURE ALUMINUM; 99.99% Al" from Alcoa of Pittsburgh, Pa. Aluminum alloys (e.g., Al-2% by weight Cu (0.03% by weight impurities) can be obtained from Belmont Metals, New York, NY. Zinc and tin are available, for example, from Metal Services, St. Paul, Minn. ("pure zinc"; 99.999% purity and "pure tin"; 99.95% purity). Examples of tin alloys include 92 wt. % Sn-8 wt. % Al (which can be made, for example, by adding the aluminum to a bath of molten tin at 550° C. and permitting the mixture to stand for 12 hours prior to use). Examples of tin alloys include 90.4 wt. % Zn-9.6 wt. % Al (which can be made, for example, by adding the aluminum to a bath of molten zinc at 550° C. and permitting the mixture to stand for 12 hours prior to use).

The particular fibers, matrix material, and process steps for making metal matrix composite articles according to the present invention are selected to provide metal matrix composite articles with the desired properties. For example, the fibers and metal matrix materials are selected to be sufficiently compatible with each other and the metal matrix composite fabrication process in order to make the desired article. Additional details regarding some preferred techniques for making aluminum and aluminum alloy matrix composites are disclosed, for example, in copending application having U.S. Ser. No. 08/492,960, now U.S. Pat. No. 6,245,425 and PCT application having publication No. WO 97/00976, published May 21, 1996, the disclosures of which are incorporated herein by reference.

Figure 5:
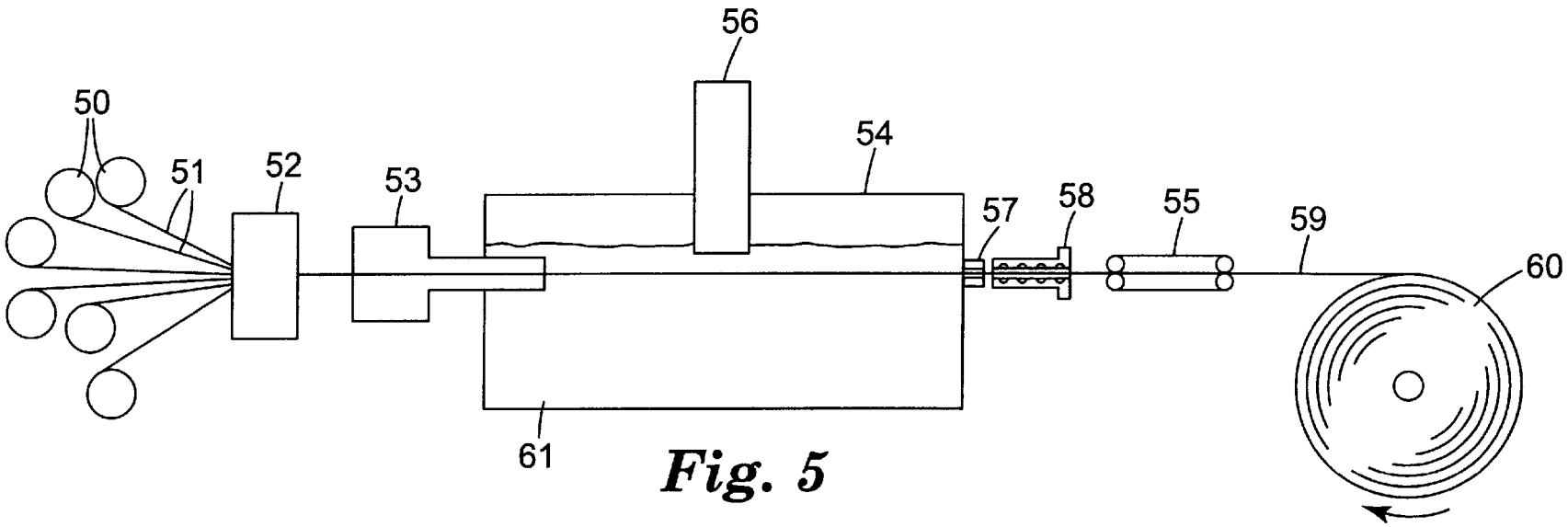
FIG. 5 is a schematic of the ultrasonic apparatus used to infiltrate fibers with molten metals.

A schematic of a preferred apparatus for metal matrix composite via the method according to the present invention is shown in FIG. 5. Tows of substantially continuous ceramic, boron, and/or carbon fibers 51 are supplied from supply spools 50, and are collimated into a circular bundle and heat-cleaned while passing through tube furnace 52. The fibers are then evacuated in vacuum chamber 53 before entering crucible 54 containing the melt of metallic matrix material 61 (also referred to herein as "molten metal"). The fibers are pulled from supply spools 50 by caterpuller 55. Ultrasonic probe 56 is positioned in the melt in the vicinity of the fiber to aid in infiltrating the melt into tows 51. The molten metal of the metal matrix composite article (e.g., wire, tap or rod, as shown) cools and solidifies after exiting crucible 54 through exit die 57, although some cooling may occur before it fully exits crucible 54. Cooling of wire 59 is enhanced by streams of gas or liquid 58. Article 59 is collected onto spool 60. Optionally, the article is tested in line using the Wire Proof Test described in the Examples, below.

Heat-cleaning the fiber aids in removing or reducing the amount of sizing, adsorbed water, and other fugitive or volatile materials that may be present on the surface of the fibers. Preferably, the fibers are heat-cleaned until the carbon content on the surface of the fiber is less than 22% area fraction. Typically, the temperature of the tube furnace is at least about 300° C., more typically, at least 1000° C. for at least several seconds at temperature, although the particular temperature(s) and time(s) will depend, for example, on the cleaning needs of the particular fiber being used.

The fibers are evacuated before entering the melt, as it has been observed that the use of such evacuation tends to reduce or eliminate the formation of defects such as localized regions with dry fibers. Preferably, in increasing order of preference, the fibers are evacuated in a vacuum of not greater than 20 Torr, not greater than 10 Torr, not greater than 1 Torr, and not greater than 0.7 Torr.

An example of a suitable vacuum system is an entrance tube sized to match the diameter of the bundle of fiber. The entrance tube can be, for example, a stainless steel or alumina tube, and is typically at least 30 cm long. A suitable vacuum chamber typically has a diameter in the range from about 2 cm to about 20 cm, and a length in the range from about 5 cm to about 100 cm. The capacity of the vacuum pump is preferably at least 0.2–0.4 cubic meters/minute. The evacuated fibers are inserted into the melt through a tube on the vacuum system that penetrates the aluminum bath (i.e., the evacuated fibers are under vacuum when introduced into the melt), although the melt is at substantially atmospheric pressure. The inside diameter of the exit tube essentially matches the diameter of the fiber bundle. A portion of the exit tube is immersed in the molten aluminum. Preferably, about 0.5–5 cm of the tube is immersed in the molten metal. The tube is selected to be stable in the molten metal material. Examples of tubes which are typically suitable include silicon nitride and alumina tubes.

Infiltration of the molten metal into the fibers is enhanced by the use of ultrasonics. For example, a vibrating horn is positioned in the molten metal such that it is in close proximity to the fibers. Preferably, the fibers are within 2.5 mm of the horn tip, more preferably within 1.5 mm of the horn tip. The horn tip is preferably made of niobium, or alloys of niobium, such as 95 wt. % Nb-5 wt. % Mo and 91 wt.% Nb-9 wt. % Mo, and can be obtained, for example, from PMTI, Pittsburgh, Pa. For additional details regarding the use of ultrasonics for making metal matrix composites, see, for example, U.S. Pat. Nos. 4,649,060 (Ishikawa et al.), 4,779,563 (Ishikawa et al.), and 4,877,643 (Ishikawa et al.), application having U.S. Ser. No. 08/492,960, and PCT application having publication No. WO 97/00976, published May 21, 1996, the disclosures of which are incorporated herein by reference.

The molten metal is preferably degassed (e.g., reducing the amount of gas (e.g., hydrogen) dissolved in the molten metal) during and/or prior to infiltration. Techniques for degassing molten metal are well known in the metal processing art. Degassing the melt tends to reduce gas porosity in the wire. For molten aluminum the hydrogen concentration of the melt is preferably, in order of preference, less than 0.2, 0.15, and 0.1 $cm^3$/100 grams of aluminum.

The exit die is configured to provide the desired shape and size (e.g., diameter or thickness and width) of the article. Typically, it is desired to have a uniformly cross-section along the length of the article. The size of the exit die is usually slightly larger than the size of the article wire. For example, the diameter of a silicon nitride exit die for an aluminum composite wire containing about 50 volume percent alumina fibers is about 3 percent smaller than the diameter of the wire. Preferably, the exit die is made of silicon nitride, although other materials may also be useful. Other materials that have been used as exit dies in the art include conventional alumina. It has been found by Applicants', however, that silicon nitride exit dies wear significantly less than conventional alumina dies, and hence are more useful in providing the desired size and shape of the article, particularly over lengths of the article.

Typically, the metal matrix composite article is cooled after exiting the exit die by contacting the article with a liquid (e.g., water) or gas (e.g., nitrogen, argon, or air). Such cooling aids in providing the desirable roundness and uniformity characteristics.

With regard to wires, for example, the diameter of the resulting wire is typically not a perfect circle. The ratio of the minimum and maximum diameter (i.e., for a given point on the length of the wire, the ratio of the shortest diameter to the largest diameter, wherein for a perfect it would be 1) is typically at least 0.8, preferably, in increasing order of desirability, at least 0.85, 0.88, 0.90, 0.91, 0.92, 0.93, 0.94, and 0.95. The cross-sectional shape of the wire may be, for example, circular, elliptical, square, rectangular, or triangular. Preferably, the cross-sectional shape of wire according to the present invention is circular, or nearly circular. Preferably, the average diameter of wire according to the present invention is at least 1 mm, more preferably, at least 1.5 mm, 2 mm, 2.5 mm, 3 mm, or 3.5 mm.

Although the desired construction and dimensions of a metal matrix composite tape made by the method of the present invention may depend on the particular use, some preferred tapes have a rectangular cross section of about 5–50 mm ×0.2–1 mm.

Certain embodiments of the method according to the present invention enable the fabrication of relatively larger diameter wires (i.e., 2.5. mm and larger). Such larger diameter wires in turn enable a wider variety of cable designs and constructions. For example, a wider variety of wires of different diameter can provide cables within a wider range of diameters, as well as a wider range of stiffness or flexibility.

Metal matrix composite wires according to the present invention can be used in a variety of applications. They are particularly useful in overhead electrical power transmission cables. The cables may be homogeneous (i.e., including only one type of metal matrix composite wire) or nonhomogeneous (i.e., including a plurality of secondary wires, such as metal wires). As an example of a nonhomogeneous cable, the core can include a plurality of wires made according to the present invention with a shell that includes a plurality of secondary wires (e.g., aluminum wires).

The cables can be stranded. A stranded cable typically includes a central wire and a first layer of wires helically stranded around the central wire. Cable stranding is a process in which individual strands of wire are combined in a helical arrangement to produce a finished cable (see, e.g., U.S. Pat. Nos. 5,171,942 (Powers) and 5,554,826 (Gentry), the disclosures of which are incorporated herein by reference). The resulting helically stranded wire rope provides far greater flexibility than would be available from a solid rod of equivalent cross sectional area. The helical arrangement is also beneficial because the stranded cable maintains its overall round cross-sectional shape when the cable is subject to bending in handling, installation and use. Helically wound cables may include as few as 7 individual strands to more common constructions containing 50 or more strands.

Figure 8:
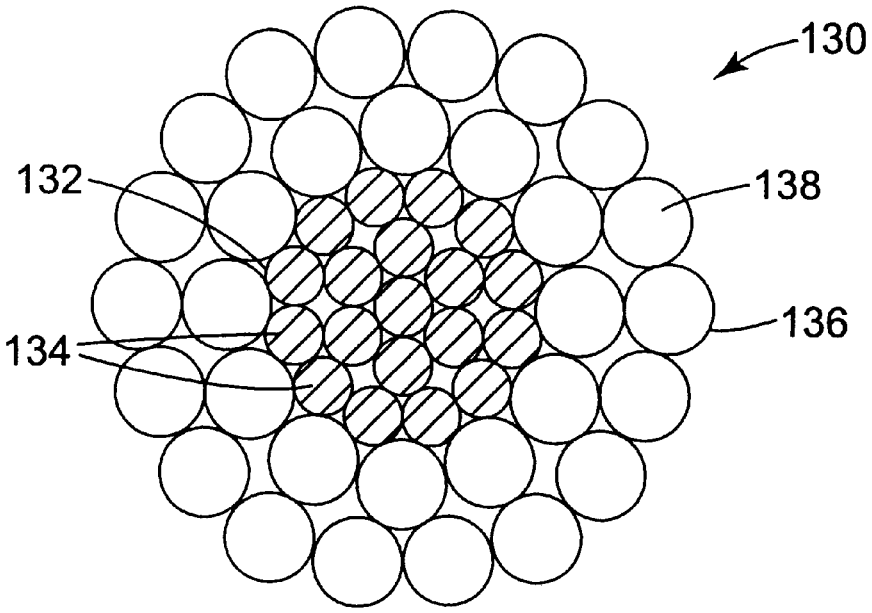
FIGS. 8 and 9 are schematic, cross-sections of two embodiments of overhead electrical power transmission cables having composite metal matrix cores.
Figure 9:
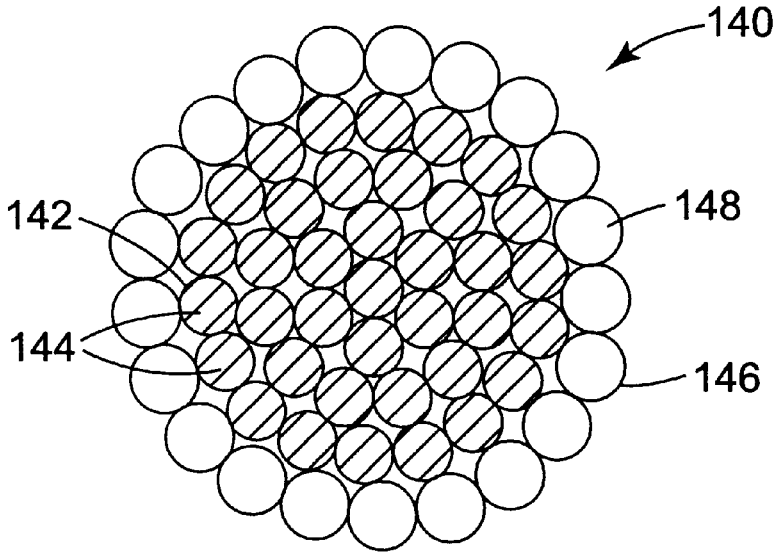

One exemplary electrical power transmission cable is shown in FIG. 8, where electrical power transmission cable 130 may be a core 132 of nineteen individual composite metal matrix wires 134 surrounded by a jacket 136 of thirty individual aluminum or aluminum alloy wires 138. Likewise, as shown in FIG. 9, as one of many alternatives, overhead electrical power transmission cable 140 may be a core 142 of thirty-seven individual composite metal matrix wires 144 surrounded by jacket 146 of twenty-one individual aluminum or aluminum alloy wires 148.

Figure 10:
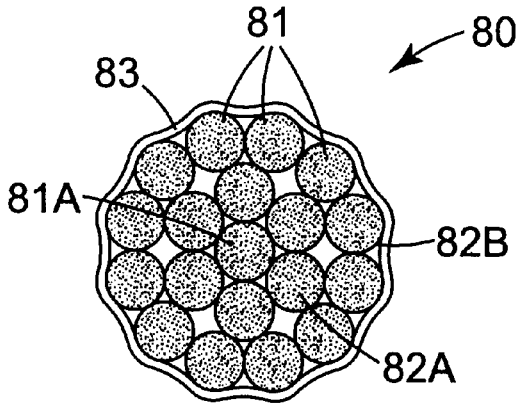
FIG. 10 is an end view of an embodiment of a stranded cable, prior to application of a maintaining means around the plurality of strands.

FIG. 10 illustrates yet another embodiment of the stranded cable 80. In this embodiment, the stranded cable includes a central metal matrix composite wire 81A and a first layer 82A of metal matrix composite wires that have been helically wound about the central metal matrix composite wire 81A. This embodiment further includes a second layer 82B of metal matrix composite wires 81 that have been helically stranded about the first layer 82A. Any suitable number of metal matrix composite wires 81 may be included in any layer. Furthermore, more than two layers may be included in the stranded cable 80 if desired.

The cables can be used as a bare cable or it can be used as the core of a larger diameter cable. Also, the cables may be a stranded cable of a plurality of wires with a maintaining means around the plurality of wires. The maintaining means may be a tape overwrap, such as shown in FIG. 10 as 83, with or without adhesive, or a binder, for example.

Stranded cables are useful in numerous applications. Such stranded cables are believed to be particularly desirable for use in overhead electrical power transmission cables due to their combination of low weight, high strength, good electrical conductivity, low coefficient of thermal expansion, high use temperatures, and resistance to corrosion.

Figure 11:
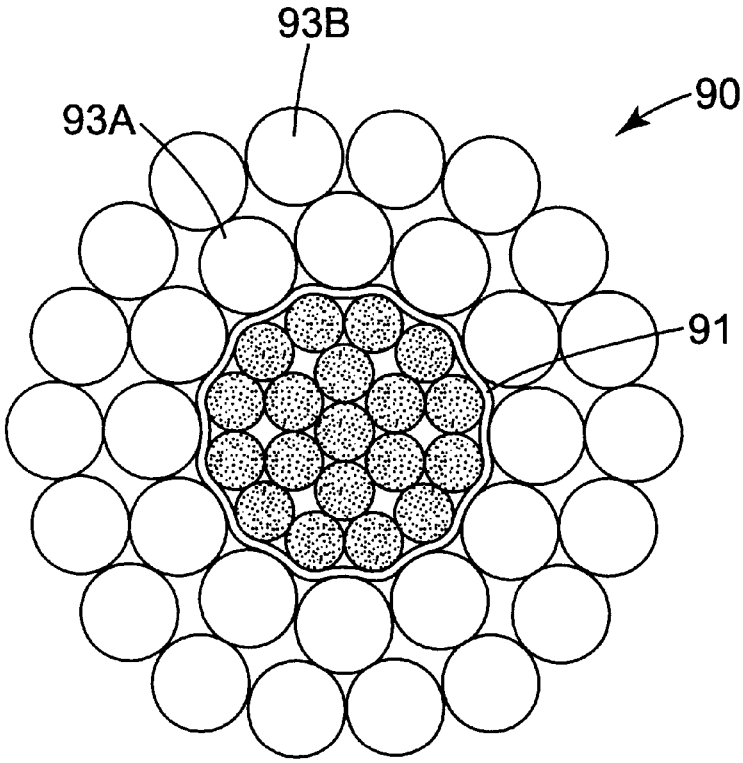
FIG. 11 is an end view of an embodiment of an electrical transmission cable.

An end view of one preferred embodiment of such a transmission cable 90 is illustrated in FIG. 11. Such a transmission cable includes a core 91 which can be any of the stranded cores described herein. The power transmission cable 90 also includes at least one conductor layer about the stranded core 91. As illustrated, the power transmission cable includes two conductor layers 93A and 93B. More conductor layers may be used as desired. Preferably, each conductor layer comprises a plurality of conductor wires as is known in the art. Suitable materials for the conductor wires includes aluminum and aluminum alloys. The conductor wires may be stranded about the stranded core 91 by suitable cable stranding equipment as is known in the art.

In other applications, in which the stranded cable is to be used as a final article itself, or in which it is to be used as an intermediary article or component in a different subsequent article, it is preferred that the stranded cable be free of electrical power conductor layers around the plurality of metal matrix composite wire 81.

Additional details regarding cables made from metal matrix composite wires are disclosed, for example, in application having U.S. Ser. No. 09/616,784 (Attorney Docket No. 55759USA2A, filed the same date as the instant application, and application having U.S. Ser. No. 08/492,960, and PCT application having publication No. WO 97/00976, published May 21, 1996, the disclosures of which are incorporated herein by reference. Additional details regarding making metal matrix composite materials and cables containing the same are disclosed, for example, in copending applications having U.S. Ser. Nos. 09/616,594, 09/616,593 and 09/616,741 (Attorney Docket Nos. 55673USA4A, 55787USA3A, and 55797USA2A, filed the same date as the instant application, the disclosures of which are incorporated herein by reference.

EXAMPLES

This invention is further illustrated by the following examples, but the particular materials and amounts thereof recited in these examples, as well as other conditions and details, should not be construed to unduly limit this invention. Various modifications and alterations of the invention will become apparent to those skilled in the art. All parts and percentages are by weight unless otherwise indicated.

Test Procedures

Three-Point Bend Strength Test

Figure 14:
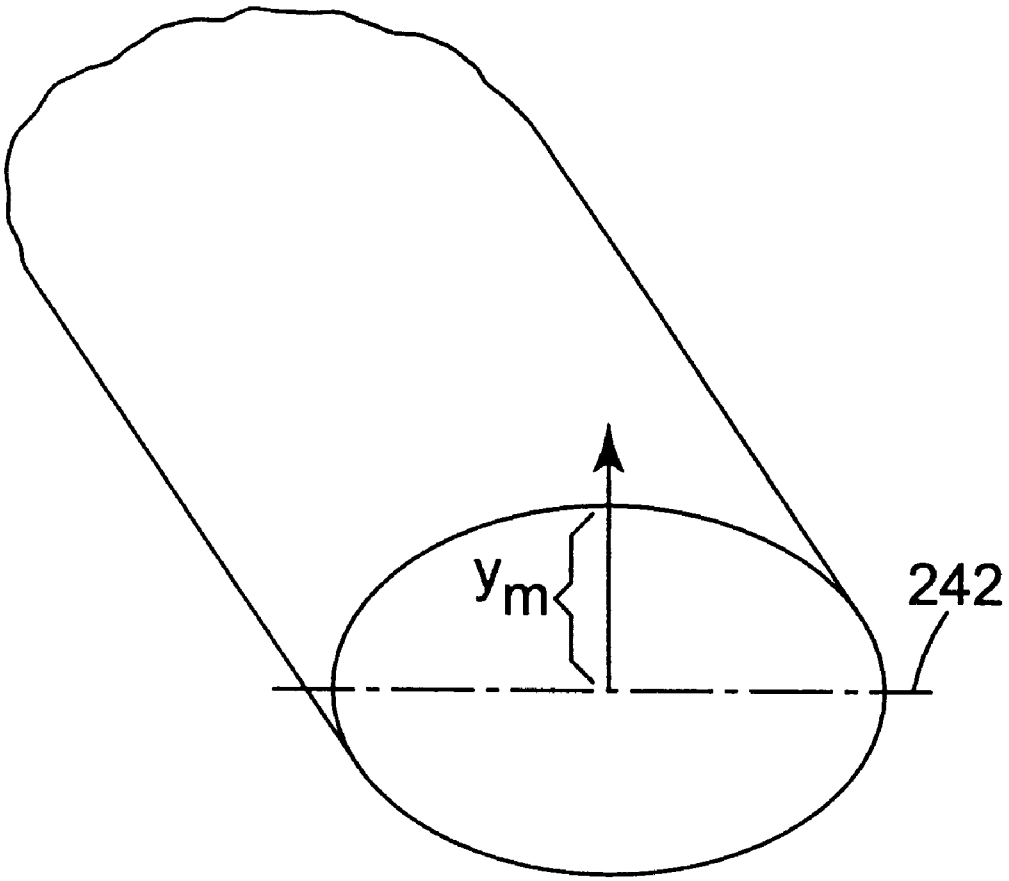
FIG. 14 is a cross-section of a test sample for the Three-Point Bend Strength Test.

The bend strength was measured using a three point bend method derived from ASTM standard E855–90, Test Method B, as published in the ASTM 1992 Annual Book of Standards, section 3, volume 03.01, published by ASTM, Philadelphia, Pa., the disclosure of which is incorporated herein by reference. The three-point bend strength is the nominal stress in the outer surface of the wire that results in the test sample breaking in two or more separate pieces. The test was carried out at room temperature (about 20° C.) on randomly selected samples using a universal test frame equipped with a three-point bend fixture and a device for continuously recording the load (both obtained from MTS., Eden Prairie, Minn.). The three-point bend strength, $\sigma_b$, of a sample, long in relation to its depth, tested in three point bending is given by Equation 1:

$$\sigma_b = \frac{y_m F l}{4I} \tag{1}$$

where F is the maximum load recorded by the load cell, l is the test span (i.e., the distance between two supports), $y_m$ is the perpendicular distance from the neutral axis to the surface of the test sample (see FIG. 14), and I is the second moment of area. Referring to FIG, 14, the second moment of area measures the resistance of the uniform section to bending about horizontal axis 242. The second moment of area is given by:

$$I = \int_{section} y^2 b(y)\, dy \tag{2}$$

where b(y) is the width of the section at y. Equations are well known for providing appropriate approximations for calculating second moment of area, I. The equations are selected to fit the cross-section of the sample. For example, for circular or nearly circular cross-sections, the second moment of area, I, is given by:

$$I = \frac{\pi d^4}{64} \tag{3}$$

where d is the diameter of the cross-section. For wires that are not perfectly circular, the Three-Point Bend Strength is measured by orienting the short axis of the wire vertically in the test apparatus. The diameter of the wire was measured using a micrometer (having precision of at least +/−2%). The wires from the examples were not perfectly circular (but were nearly circular). Therefore, both the minimum and maximum diameters (for the same points on the wire) were measured. The ratio of the minimum to maximum diameter of the wires from the examples were all greater than 0.9. For each test sample, the minimum diameter was measured every 5 cm along a 15 cm length, for a total of three diameter measurement readings. Since the cross-sections of the wires from the examples were nearly circular, Equation 3 (above) was used for the second moment of area, I. The diameter, d, used in the equation was the average of the three minimum diameter readings.

Figure 6:
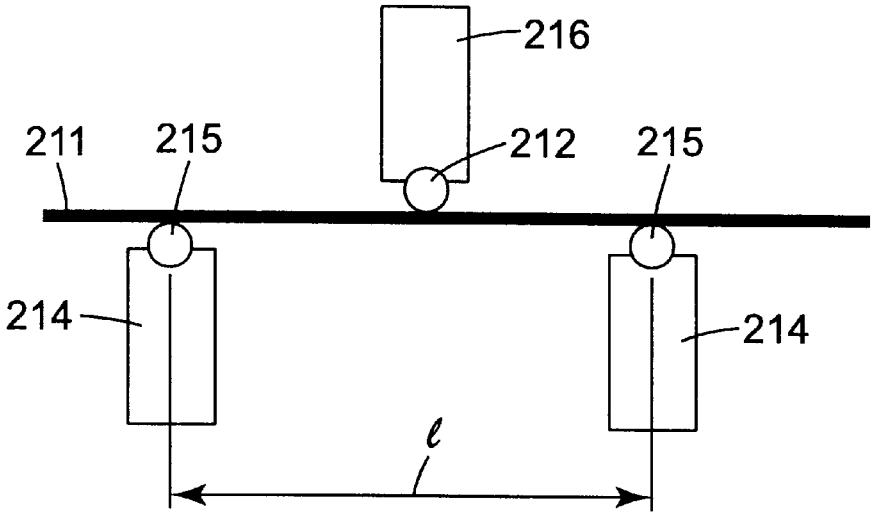
FIG. 6 is a schematic of the Three-Point Bend Strength Test apparatus.

The test specimen was loaded as a simple beam in three-point symmetrical loading. The bend strength was obtained by monotonic loading until the wire broke. The load at failure P was recorded and used to calculate the three-point bend strength according to Equation 1 (with Equation 3). A schematic of the test apparatus for is shown in FIG. 6. The apparatus consisted of two adjustable supports 214, means of applying a load 212, and means of measuring load 216. The supports were hardened steel pins with a radius of 3 mm at the supporting edge. The separation between the supports was adjustable along the specimen longitudinal axis. Sample to be tested is shown as 211.

The test specimens were straight, not wavy or twisted. The span was between 15 to 22 times the wire minimum diameter (d). The total specimen length was at least 50 times the wire minimum diameter (d). The specimen was be placed symmetrically on the supports, and gently taped by hand to minimize friction at the supports.

The Three-Point Bend Strength used for the Wire Proof Test, described below, was the average of Three-Point Bend Strengths from eight samples.

Wire Proof Test

Figure 7:
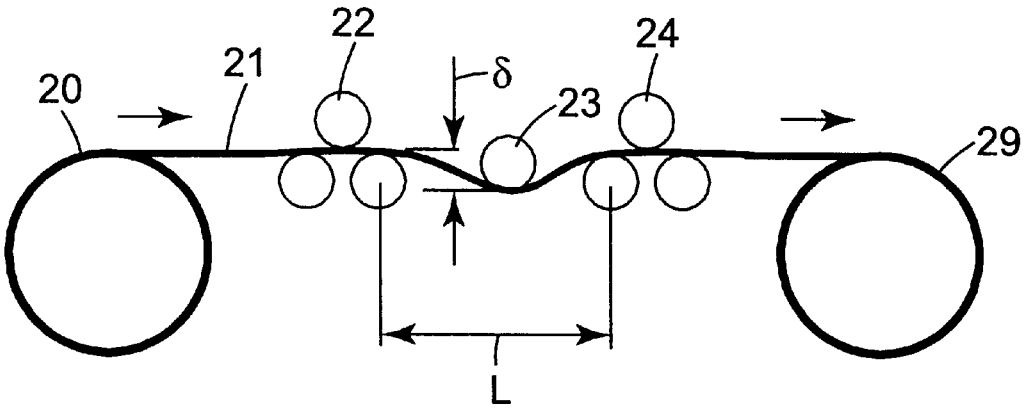
FIG. 7 is a schematic of the Wire Proof Test apparatus.

The wire was continuously proof tested at room temperature (about 20° C.) in a bending mode at a set value of the measured Three-Point Bend Strength using an apparatus, schematic of which is illustrated in FIG. 7. Wire (to be tested) 21 was supplied from spool 20, guided through first and second sets of three rollers 22 and 24 and deflected by 4 cm diameter roller 23 over test span L, and collected on spool 29. Spool 29 was driven to pull the wire from spool 20 through the test apparatus. Roller sets 22 and 24 were 40 mm diameter steel bearings. The outside surfaces of rollers in roller sets 22 and 24 each had a small V-groove centrally located around the diameter of the roller. The V-groove was about 1 mm deep by about 1 mm wide. The wire being tested was aligned in the V-groove to travel perpendicular to the axis of the rollers during the test. The two lower rollers in each of roller sets 22 and 24 were spaced 100 mm apart center to center. The upper roller of each of roller sets 22 and 24 were spaced symmetrically between the two respective lower rollers. The vertical position of the upper roller of each of roller sets 22 and 24 were adjustable. The separation between the outer surfaces of the upper and lower rollers of each of roller sets 22 and 24 was equal to the (average minimum) wire diameter, as calculated for the Three-Point Bend Strength Test, above (i.e., d). The separation was such that the wire 21 was supported but could freely travel between the upper and lower rollers in roller sets 22 and 24 with minimal tension (i.e., less than 1 Newton). Center roller 23 is a 40 mm outside diameter steel bearing located symmetrically between the roller sets 22 and 24. The tension in the wire between spools 20 and 29 was not greater than 100 Newtons for wire having a (average minimum) diameter, as calculated for the Three Point-Bend Strength Test, above (i.e., d), greater or equal to 1.5 mm. The tension in the wire between spools 20 and 29 was not greater than 20 Newton for wire having a (average minimum) diameter, as calculated for the Three-Point Bend Strength Test, above (i.e., d) less than 1.5 mm. The span, L, for the Wire Proof Test was the center to center distance between the inside rollers in the roller sets 22 and 24. Span, L, was set between 120–260times the (average minimum) wire diameter, as calculated for the Three-Point Bend Strength Test, above (i.e., d). The deflection of the center roller, δ, was the distance between the centerline of a straight wire going through roller sets 22 and 24 and the lower surface of roller 23. Proof testing was carried out with the wire traveling at a speed of 0.1–10 meters/min. The deflection δ of the center roller was set to apply a stress equivalent to 75% of the three-point bend strength of the wire as determined by the Three-Point Bend Strength Test.

The deflection, δ, of central roller 23 forcing the wire being tested to be subjected to a stress equal to 75% of the Three-Point Bend Strength (obtained as described above in the Three-Point Bend Strength Test) was given by Equation 4:

$$\delta = \frac{L^2}{24Ey_m}(0.75\sigma_b) \tag{4}$$

where L was the span, E the Young's modulus of the wire, $y_m$ was as defined above in the Three-Point Bend Strength Test, and $\sigma_b$ was the Three-Point Bend Strength (determined as above in the Three-Point Bend Strength Test). For cylindrical or nearly cylindrical wires the axis of the minimum diameter of the wire is oriented vertically in the Wire Proof Test apparatus, the deflection was given by $$\delta = \frac{L^2}{12Ed}(0.75\sigma_b) \tag{5}$$

Where d is the (average minimum) wire diameter (determined above in the Three-Point Bend Strength Test) and E is the modulus of the wire. The Young's modulus of the wire, E, was estimated by:

$$E = fE_f \tag{6}$$

where f was the fiber volume fraction (determined as described below) and $E_f$ the Young's modulus of the fiber. The applied deflection intended to cause the wire to break when the local wire strength was less than 75% of the Three-Point Bend Strength.

The fiber volume fraction was measured by a standard metallographic technique. The wire cross-section was polished and the fiber volume fraction measured by using the density profiling functions with the aid of a computer program called NIH IMAGE (version 1.61), a public domain image-processing program developed by the Research Services Branch of the National Institutes of Health (obtained from website http//rsb.info.nih.gov/nih-image). This software measured the mean gray scale intensity of a representative area of the wire.

A piece of the wire was mounted in mounting resin (obtained under the trade designation "EPOXICURE" from Buehler Inc., Lake Bluff, Ill.). The mounted wire was polished using a conventional grinder/polisher and conventional diamond slurries with the final polishing step using a 1 micrometer diamond slurry obtained under the trade designation "DIAMOND SPRAY" from Struers, West Lake, Ohio) to obtain a polished cross-section of the wire. A scanning electron microscope (SEM) photomicrograph was taken of the polished wire cross-section at 150×. When taking the SEM photomicrographs, the threshold level of the image was adjusted to have all fibers at zero intensity, to create a binary image. The SEM photomicrograph was analyzed with the NIH IMAGE software, and the fiber volume fraction obtained by dividing the mean intensity of the binary image by the maximum intensity. The accuracy of this method for determining the fiber volume fraction was believed to be +/−2%.

Example 1

Example 1 aluminum composite wire was prepared as follows. Referring to FIG. 5, sixty-six tows of 1500 denier alumina fibers (available from the 3M Company under the trade designation "NEXTEL 610"; Young's modulus reported in 1996 product brochure was 373 GPa) were collimated into a circular bundle. The circular bundle was heat cleaned by passing it, at a rate of 1.5 m/min., through a 1 meter tube furnace (obtained from ATS, Tulsa Okla.), in air, at 1000° C. The circular bundle was then evacuated at 1.0 Torr by passing the bundle through an alumina entrance tube (2.7 mm in diameter, 30 cm in length; matched in diameter to the diameter of the fiber bundle) into a vacuum chamber (6 cm in diameter; 20 cm in length). The vacuum chamber was equipped with a mechanical vacuum pump having a pumping capacity of 0.4 $m^3$/min. After exiting the vacuum chamber, the evacuated fibers entered a molten aluminum bath through an alumina tube (2.7 mm internal diameter and 25 cm in length) that was partially immersed (about 5 cm) in the molten aluminum bath. The molten aluminum bath was prepared by melting aluminum (99.94% pure Al; obtained from NSA ALUMINUM, HAWESVILLE, Ky.) at 726° C. The molten aluminum was maintained at about 726° C., and was continuously degassed by bubbling 800 $cm^3$/min. of argon gas through a silicon carbide porous tube (obtained from Stahl Specialty Co, Kingsville, Mo.) immersed in the aluminum bath. The hydrogen content of the molten aluminum was measured by quenching a sample of the molten aluminum in a copper crucible having a 0.64 cm×12.7 cm×7.6 cm cavity, and analyzing the resulting solidified aluminum ingot for its hydrogen content using a standardized mass spectrometer test analysis (obtained from LECO Corp., St. Joseph, Mich.).

Infiltration of the molten aluminum into the fiber bundle was facilitated through the use of ultrasonic infiltration.

Ultrasonic vibration was provided by a wave-guide connected to an ultrasonic transducer (obtained from Sonics & Materials, Danbury Conn.). The wave guide consisted of a 91 wt % Nb-9 wt % Mo cylindrical rod, 25 mm in diameter by 90 mm in length attached with a central 10 mm screw, which was screwed to a 482 mm long, 25 mm in diameter titanium waveguide (90 wt. % Ti-6 wt. % Al-4 wt. % V). The Nb-9 wt % Mo rod was supplied by PMTI, Inc., Large, Pa. The niobium rod was positioned within 2.5 mm of the centerline of the fiber bundle. The wave-guide was operated at 20 kHz, with a 20 micrometer displacement at the tip. The fiber bundle was pulled through the molten aluminum bath by a caterpuller (obtained from Tulsa Power Products, Tulsa Okla.) operating at a speed of 1.5 meter/minute.

The aluminum infiltrated fiber bundle exited the crucible through a silicon nitride exit die (inside diameter 2.5 mm, outside diameter 19 mm and length 12.7 mm; obtained from Branson and Bratton Inc., Burr Ridge, Ill.). After exiting the molten aluminum bath, cooling of the wire was aided with the use of two streams of nitrogen gas. More specifically, two plugged tubes, having 4.8 mm inside diameters, were each perforated on the sides with five holes. The holes were 1.27 mm in diameter, and located 6 mm apart along a 30 mm length. Nitrogen gas flowed through the tubes at a flow rate of 100 liters per minutes, and exited through the small side holes. The first hole on each tube was positioned about 50 mm from the exit die, and about 6 mm away from the wire. The tubes were positioned, one on each side of the wire. The wire was then wound onto a spool. The composition of the Example 1 aluminum matrix, as determnined by inductively coupled plasma analysis, was 0.03 wt. % Fe, 0.02 wt. % Nb, 0.03 wt. % Si, 0.01 wt. % Zn, 0.003 wt. % Cu, and the balance Al. While making the wire, the hydrogen content of the aluminum bath was about 0.07 $cm^3$/100 gm aluminum.

Ten spools of aluminum composite wire 2.5 mm in diameter were prepared for Example 1. Each spool contained at least 300 meters of wire; some of the coils as much as 600 meters of wire.

The wire bend strength, as measured according to the "Bend Strength Test" using a 50.8 mm test span, was determined to be 1.79 GPa. The average fiber content of the wire was determined to be 52 volume percent, and the modulus, using Equation 6, to be 194 GPa. The wire was then proof tested according to the "Wire Proof Test" using a 406 mm span and a deflection of 38.1 mm. All ten coils of the wire passed the Wire Proof test without any breaks.

Example 2

Example 2 aluminum matrix composite wires were prepared substantially as described in Example 1, except the wire processing speed was varied between 1.5 meters/min. and 4 m/min. The length of the wire made at a given speed varied between 20 meters and 300 meters depending on the frequency of breaks detected in the Wire Proof Test. The length was at least 300 meters if the wire did not break; otherwise enough wire was made to collect at least three breaks. At processing speeds of 1.5 m/min. and 2.3 m/min., the wire did not break in the Wire Proof Test (i.e., there were zero breaks) after running 300 meters of wire. At a speed of about 3.55 m/min., the wire broke on average every 6 meters. At a speed of 4 m/min., the wire broke on average every meter. For samples that did not pass the Wire Proof Test, the test was run until there were at least three breaks. Break fracture surfaces were observed using scanning electron microscopy. Dry fibers (i.e., uninfiltrated fibers) were observed at the fracture surfaces.

Example 3

Example 3 aluminum matrix composite wires were prepared substantially as described in Example 1, except that the diameter of the wire was varied between 1 mm and 2.5 mm, and the wire speed was also varied for each wire diameter.

A 1 mm diameter wire was made at a processing speed of 6.1 m/min. Thishe wire passed the Wire Proof Test with zero breaks along a 300 meter length. At processing speeds greater or equal to about 10 m/min. dry fibers were observed. Further, such wire did not pass the Wire Proof Test over a 300 meter length.

A 2.5 mm diameter wire was made at a processing speed of 4 meters/min. This wire passed the Wire Proof Test with zero breaks along a 300 meters length. At processing speeds greater or equal to about 4 m/min. dry fibers were observed. Further, such wire did not pass the Wire Proof Test over a 300 meter length.

Example 4

Example 4 aluminum matrix composite wires were prepared substantially as described in Example 1, except the vacuum was varied between about 1 Torr and 760 Torr (atmospheric pressure).

A 2.5 mm diameter wire was made at a processing speed of 2.3 m/min. under a vacuum of 1 Torr. This wire passed the Wire Proof Test with zero breaks along a 300 meters length. When made at a processing speed of 2.3 m/min. under atmospheric pressure (i.e., 760 Torr), the 2.5 mm diameter wire consistently broke in the Wire Proof Test. It was observed that the fiber was not fully infiltrated with aluminum. When the processing speed was reduced to less than 0.1 m/min. dry fiber was still observed.

A 1 mm diameter wire was made at a processing speed of 6.1 meters/min. with a vacuum of 1 Torr. This wire passed the Wire Proof Test with zero breaks along a 300 meter length. A 1 mm diameter wire was made at a processing speed of 3 m/min. with no vacuum (i.e., 760 Torr). The passed the Wire Proof Test with zero breaks along a 300 meter length. The 1 mm diameter wire consistently broke in the Wire Proof Test, however, when made at a processing speed of 6.1 m/min. with no vacuum (i.e., 760 Torr).

Example 5

Example 9 aluminum matrix composite wires were prepared substantially according to Example 1 except the fiber was heat-cleaned at a rate of 1.5 m/min. through a 3 cm diameter, 0.3 meter long tube furnace set at 1000° C. Multiple 300 meter long wire coils passed the Wire Proof Test with zero breaks.

The surface chemistry of the ceramic fiber ("NEXTEL 610") was evaluated, before and after heat-cleaning. The fiber was cleaned by heating it at 1000° C. for 12 seconds. The fiber was analyzed using Electron Spectroscopy for Chemical Analysis (ESCA) (also known as X-ray Photoelectron Spectroscopy (XPS)). The ESCA equipment used was obtained under the trade designation "HP5950A" from Hewlett-Packard of Palo Alto, Calif. The ESCA equipment included a hemispherical electron energy analyzer, and operated in a constant pass energy mode. The X-ray source was aluminum K-alpha. The probe angle was a 38 degree photoelectron take-off angle as measured with respect to the analyzer correction lens axis. Quantitative data was calculated using software and sensitivity factors provided by the instrument. manufacturer. The carbon spectrum after heating indicated less than 22% area fraction carbon on the fiber.

Wire was prepared substantially according to Example 1 except that local carbon contamination was purposefully introduced after the tube furnace by spraying cleaner available under the trade name "CITRUS CLEANER" from the 3M Company over a 2-cm section of fiber. The wire broke in the Wire Proof Test exactly where the surface contamination was introduced.

Wire was also prepared using fiber contaminated with fingerprints. The carbon spectrum in such contaminated samples was measured to be more than 34% per area fraction. Such carbon contamination is believed to increase the contact angle and cause losses of infiltration.

Example 7

Example 7 aluminum matrix composite wires were prepared substantially as described in Example 1 except that the melt was not degassed with argon for at least 24 hours prior to making wire. The wire diameter was 2.5 mm and the processing speed was 2.3 m/min. The wire broke at least three times in the Wire Proof Test over a 300-meter length. The fracture surface was analyzed and, although not wanting to be bound by theory, it is believed that the cause of the break was due to large voids resulting from hydrogen gas. The voids were about 0.5 mm in diameter and 2–3 mm in length or more. Without the melt degassing treatment described in Example 1, the typical hydrogen concentration was approximately 0.3 $cm^3$/100 grams of aluminum.

A wire was also prepared substantially as described in Example 1 except that the melt was degassed with argon 2 hours before making wire. The wire diameter was 2.5 mm and the processing speed was 2.3 meters/min. The wire passed the Wire Proof Test without a break. The typical hydrogen concentration with the melt degassing treatment was approximately 0.07–0.1 $cm^3$/100 grams of aluminum.

Example 8

Figure 12:
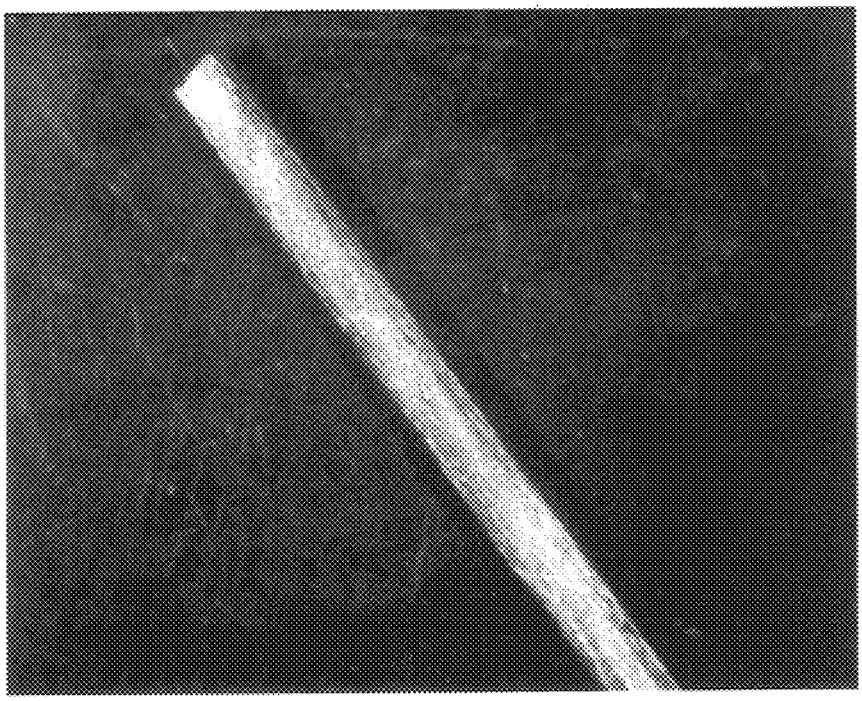
FIG. 12 is a scanning electron micrograph of a fracture surface an aluminum matrix composite wire from Example 8.
Figure 13:
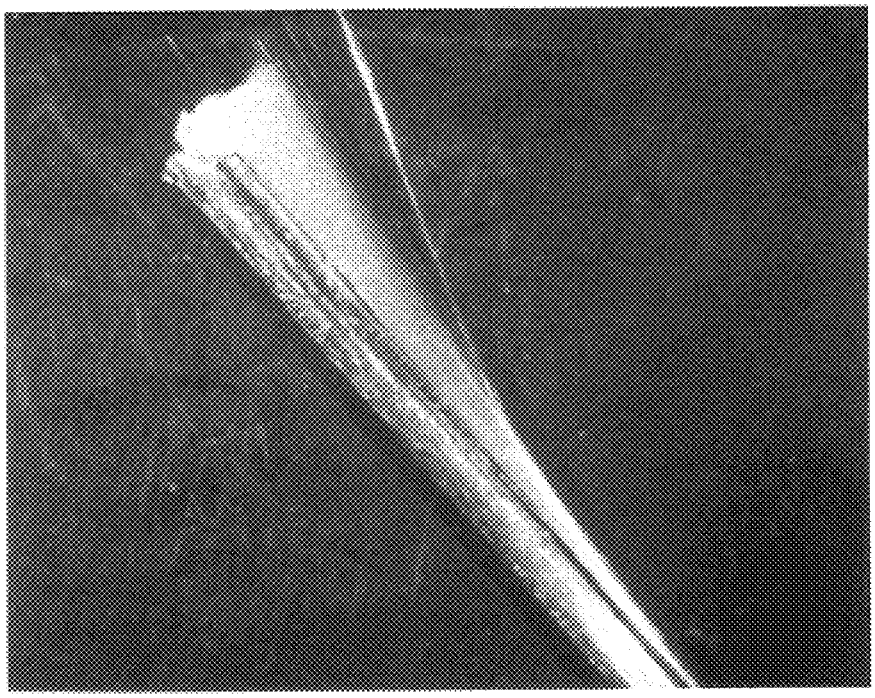
FIG. 13 is a scanning electron micrograph of a fracture surface another aluminum matrix composite wire from Example 8.

Example 8 aluminum matrix composite wires were prepared substantially as described in Example 1, except the wire diameter was 2.5 mm in diameter and the vacuum was varied between 1 Torr and atmospheric pressure. The 2.5 mm wire was fully infiltrated when made under a vacuum of 1 Torr (see the SEM photograph in FIG. 12). The vacuum pump was turned off with all other conditions remaining the same. The pressure in the vacuum chamber reached atmospheric pressure. The infiltration was then partially lost at 1 atmosphere and a large number of un-infiltated fibers was visible. Torr (see the SEM photograph in FIG. 13).

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method for making a continuous, elongated metal composite article, the method comprising:

providing a contained volume of molten metallic matrix material at substantially atmospheric pressure;

providing a vaccuum chamber having an exit aperture immersed in the contained volume of molten metallic matrix material;

evacuating a plurality of at least one of substantially continuous, longitudinally poistioned ceramic, boron, or carbon fibers by passing them through the the vacuum chamber;

introducing the evacuated plurality of substantially continuous fibers into the contained volume of molten metallic matrix material through the vacuum chamber exit aperture;

imparting ultrasonic energy to cause vibration of at least a portion of the contained volume of molten metal matrix material to permit at least a portion of the molten metal matrix material infiltrate into the plurality of substantially continuous fibers such that an infiltrated plurality of fibers is provided; and withdrawing the infiltrated plurality of fibers from the contained volume of molten metallic matrix material under conditions which permit the molten metallic matrix material to solidify to provide a continuous, elongated metal composite article comprising a plurality of at least one of substantially continuous, longitudinally positioned ceramic, boron, or carbon fibers in a metal matrix, wherein the article comprises at least 15 percent by volume of the fibers, based on the total volume of the fibers and matrix material, and wherein the article has a length of at least 10 meters.

2. The method of claim 1 wherein the vacuum is less than 20 Torrs.

3. The method of claim 1 wherein the vacuum is less than 10 Torrs.

4. The method of claim 1 wherein the vacuum is less than 1 Torr.

5. The method of claim 1 wherein the article is a wire.

6. The method of claim 5 wherein the vacuum is less than 20 Torrs.

7. The method of claim 5 wherein the vacuum is less than 10 Torrs.

8. The method of claim 5 wherein the vacuum is less than 1 Torr.

9. The method of claim 5 wherein the metal matrix comprises aluminum, zinc, tin, or alloys thereof.

10. The method of claim 5 wherein the wire has a diameter of at least 2.5 mm.

11. The method of claim 5 wherein the wire has a diameter of at least 2.5 mm over a length of at least 100 meters.

12. The method of claim 5 wherein the wire has a diameter of at least 2.5 mm over a length of at least 300 meters.

13. The method of claim 5 wherein the wire has a diameter of at least 3 mm.

14. The method of claim 5 wherein the wire has a diameter of at least 3 mm over a length of at least 100 meters.

15. The method of claim 5 wherein the wire has a diameter of at least 3 mm over a length of at least 300 meters.

16. The method of claim 5 further comprising the step of heat-cleaning the plurality of substantially continuous fibers above 300° C. prior to the evacuating step.

17. The method wire of claim 5 wherein the metal matrix comprises aluminum or alloys thereof.

18. The method of claim 5 wherein at least about 85% by number of the fibers are substantially continuous.

19. The method claim 5 wherein the plurality of substantially continuous fibers comprise between about 20 volume percent and about 70 volume percent of the total volume of the wire.

20. The method of claim 5 wherein the fibers are ceramic fibers.

21. The method of claim 5 wherein the fibers are ceramic oxide fibers.

22. The method of claim 5 wherein the fibers are polycrystalline, alpha alumina-based fibers.

23. The method of claim 5 wherein the wire has a length of at least about 50 meters.

24. The method of claim 5 wherein the wire has a length of at least about 100 meters.

25. The method of claim 5 wherein the wire has a length of at least about 300 meters.

26. The method of claim 5 wherein the wire has a length of at least about 900 meters.

27. The method of claim 1 wherein the fibers are ceramic fibers.

28. The method of claim 1 wherein the fibers are ceramic oxide fibers.

29. The method of claim 1 wherein the fibers are polycrystalline, alpha alumina-based fibers.

30. The method of claim 1 wherein the molten metallic matrix material is aluminum, and the hydrogen concentration of the molten aluminum matrix material is less than 0.2 $cm^3$/100 grams of aluminum.

31. The method of claim 1 wherein the molten metallic matrix material is aluminum, and the hydrogen concentration of the molten aluminum matrix material is less than 0.15 $cm^3$/100 grams of aluminum.

32. The method of claim 1 wherein the molten metallic matrix material is aluminum, and the hydrogen concentration of the molten aluminum matrix material is less than 0.1 $cm^3$/100 grams of aluminum.

* * * * *

UNITED STATES PATENT AND TRADEMARK OFFICE

CERTIFICATE OF CORRECTION

PATENT NO. : 6,485,796 B1
DATED : November 26, 2002
INVENTOR(S) : Michael W. Carpenter It is certified that error appears in the above-identified patent and that said Letters Patent is hereby corrected as shown below:

Title page,
Item [75], Inventors, "John L. Sinz", should read -- John I. Sinz --
Item [56], OTHER PUBLICATIONS, "H. Gigerenzer et. al." reference, "ASM Joint Composite Material Committee", should read -- ASM Joint Composite Materials Committee --

Column 4,
Line 26, "theory, Applicants" should read -- theory. Applicants --

Signed and Sealed this

Fourth Day of March, 2003

JAMES E. ROGAN
*Director of the United States Patent and Trademark Office*